US007709089B2

(12) United States Patent
Fushitani et al.

(10) Patent No.: US 7,709,089 B2
(45) Date of Patent: May 4, 2010

(54) FLAMEPROOF RAYON FIBER AND METHOD FOR MANUFACTURING THE SAME

(75) Inventors: Shigeo Fushitani, Shimane (JP); Masaru Nakano, Shimane (JP)

(73) Assignees: Daiwabo Holdings Co., Ltd., Osaka (JP); Daiwabo Rayon Co., Ltd., Osaka (JP)

( * ) Notice: Subject to any disclaimer, the term of this patent is extended or adjusted under 35 U.S.C. 154(b) by 0 days.

(21) Appl. No.: 11/990,236

(22) PCT Filed: Aug. 22, 2006

(86) PCT No.: PCT/JP2006/316351

§ 371 (c)(1),
(2), (4) Date: Feb. 8, 2008

(87) PCT Pub. No.: WO2007/023777

PCT Pub. Date: Mar. 1, 2007

(65) Prior Publication Data

US 2009/0030131 A1 Jan. 29, 2009

(30) Foreign Application Priority Data

Aug. 26, 2005 (JP) ..... 2005-246358

(51) Int. Cl.
*B32B 23/00* (2006.01)

(52) U.S. Cl. ..... 428/393; 162/181.2; 162/181.7

(58) Field of Classification Search ..... 428/393; 162/181.2, 181.7

See application file for complete search history.

(56) References Cited

U.S. PATENT DOCUMENTS

| | | | | |
|---|---|---|---|---|
| 3,565,749 | A | 2/1971 | Wizon | |
| 5,194,120 | A * | 3/1993 | Peats et al. | 162/168.3 |
| 5,417,752 | A | 5/1995 | Parén et al. | |
| 6,358,365 | B1 * | 3/2002 | Zhang et al. | 162/181.7 |
| 6,379,501 | B1 * | 4/2002 | Zhang et al. | 162/181.7 |
| 6,565,613 | B1 * | 5/2003 | Winetzky | 8/137 |
| 2009/0030131 | A1 * | 1/2009 | Fushitani et al. | 524/456 |

FOREIGN PATENT DOCUMENTS

| | | |
|---|---|---|
| GB | 1064271 | 7/1963 |

(Continued)

*Primary Examiner*—N. Edwards
(74) *Attorney, Agent, or Firm*—Hamre, Schumann, Mueller & Larson, P.C.

(57) ABSTRACT

A rayon fiber that does not use a halide-based flame retardant, a phosphorous flame retardant or an organic solvent, has excellent flameproofness and launderability and is biodegradable when buried in the soil at the time of disposal, and a method for manufacturing the same are provided. The flameproof rayon fiber according to the present invention contains components of silicon and magnesium, and a compound containing the components of silicon and magnesium is amorphous. This rayon fiber can be manufactured by preparing a viscose solution, adding a solution containing a silicate compound containing an alkali metal to the viscose solution so as to make a silicic compound-added viscose spinning solution containing the alkali metal, performing spinning by extruding the silicate compound-added viscose spinning solution containing the alkali metal through a spinneret into a spinbath containing a sulfuric acid, thus producing a fiber to be treated containing the silicate compound, and treating the fiber to be treated using a magnesium-containing solution in a scouring process or an aftertreatment process.

3 Claims, 1 Drawing Sheet

FOREIGN PATENT DOCUMENTS

| | | |
|---|---|---|
| JP | 5-31705 | 2/1993 |
| JP | 10-204773 | 8/1998 |
| JP | 2000-136428 | 5/2000 |
| JP | 3179104 | 6/2001 |
| JP | 2001-329461 | 11/2001 |
| WO | WO 93/13249 | 7/1993 |
| WO | WO 95/24525 | 9/1995 |
| WO | WO 2005/118922 A1 | 12/2005 |
| WO | WO 2006/012041 A1 | 2/2006 |

* cited by examiner

FLAMEPROOF RAYON FIBER AND METHOD FOR MANUFACTURING THE SAME

TECHNICAL FIELD

The present invention relates to a rayon fiber having flameproofness and a method for manufacturing the same.

BACKGROUND ART

Conventionally, with regard to cellulose fibers having flame resistance and the methods for manufacturing the same, cellulose fibers using a general halide-based flame retardant or phosphorous flame retardant (red phosphorus, reactive phosphorus compound or the like) have been known. Additionally suggested are the impregnation of cellulose fibers with an organic solvent that swells the cellulose fibers and an inorganic compound that is dissolved in that organic solvent, followed by drying (see Patent document 1), and cellulose fibers containing silicon dioxide (see Patent document 2). There also have been a suggestion of treating with an aluminum compound cellulose fibers obtained from viscose mixed with sodium silicate, thus forming aluminum silicate in the cellulose fibers (see Patent document 3), and a suggestion of allowing a compound having a phosphoryl group (a phosphorus compound such as a condensed phosphoric acid) to be contained uniformly in cellulose, thus forming a hydrated compound layer having aluminum as an essential component on the surface of the cellulose fibers (see Patent document 4).

Patent document 1: JP 5 (1993)-31705 A
Patent document 2: GB 1,064,271 B
Patent document 3: JP 3179104 B
Patent document 4: JP 2001-329461 A However, the cellulose fibers disclosed in Patent document 1 are obtained by impregnating the cellulose with the inorganic compound serving as a flame retardant, and the use of the organic solvent for impregnation causes a problem of putting a load on the environment. The cellulose fibers disclosed in Patent document 2 have poor launderability because the silicon dioxide is susceptible to alkalis and eluted by an alkaline component contained in a detergent. The cellulose fibers disclosed in Patent documents 3 and 4 use the aluminum compounds. It has been suggested that aluminum may exhibit neurotoxicity and thus may pose a question of safety. In particular, the cellulose fibers disclosed in Patent document 3 are treated with a water-soluble aluminum compound, so that aluminum ions are contained in a drainage water. The aluminum ions are highly toxic to animals and plants, and thus the influence on the environment becomes a problem.

Furthermore, aramid fibers, etc. have been known as a highly flameproof material. However, there are problems in that the aramid fibers cannot be burned at the time of disposal and are not decomposed when buried in the soil.

DISCLOSURE OF INVENTION

In order to solve the conventional problems described above, the present invention provides a rayon fiber that does not use a halide-based flame retardant, a phosphorous flame retardant or an organic solvent, has excellent flame resistance and launderability and is biodegradable when buried in the soil at the time of disposal, and a method for manufacturing the same.

A flameproof rayon fiber according to the present invention contains components of silicon and magnesium, characterized in that a compound containing the components of silicon and magnesium is amorphous.

A method for manufacturing a flameproof rayon fiber according to the present invention includes preparing a viscose solution, adding a solution containing a silicic compound containing an alkali metal to the viscose solution so as to make a silicic compound-added viscose spinning solution containing the alkali metal, performing spinning by extruding the silicic compound-added viscose spinning solution containing the alkali metal through a spinneret into a spinbath containing a sulfuric acid, thus producing a fiber to be treated containing the silicic compound, and treating the fiber to be treated using a magnesium-containing solution in a scouring process or an aftertreatment process.

DESCRIPTION OF THE INVENTION

Figure 1:
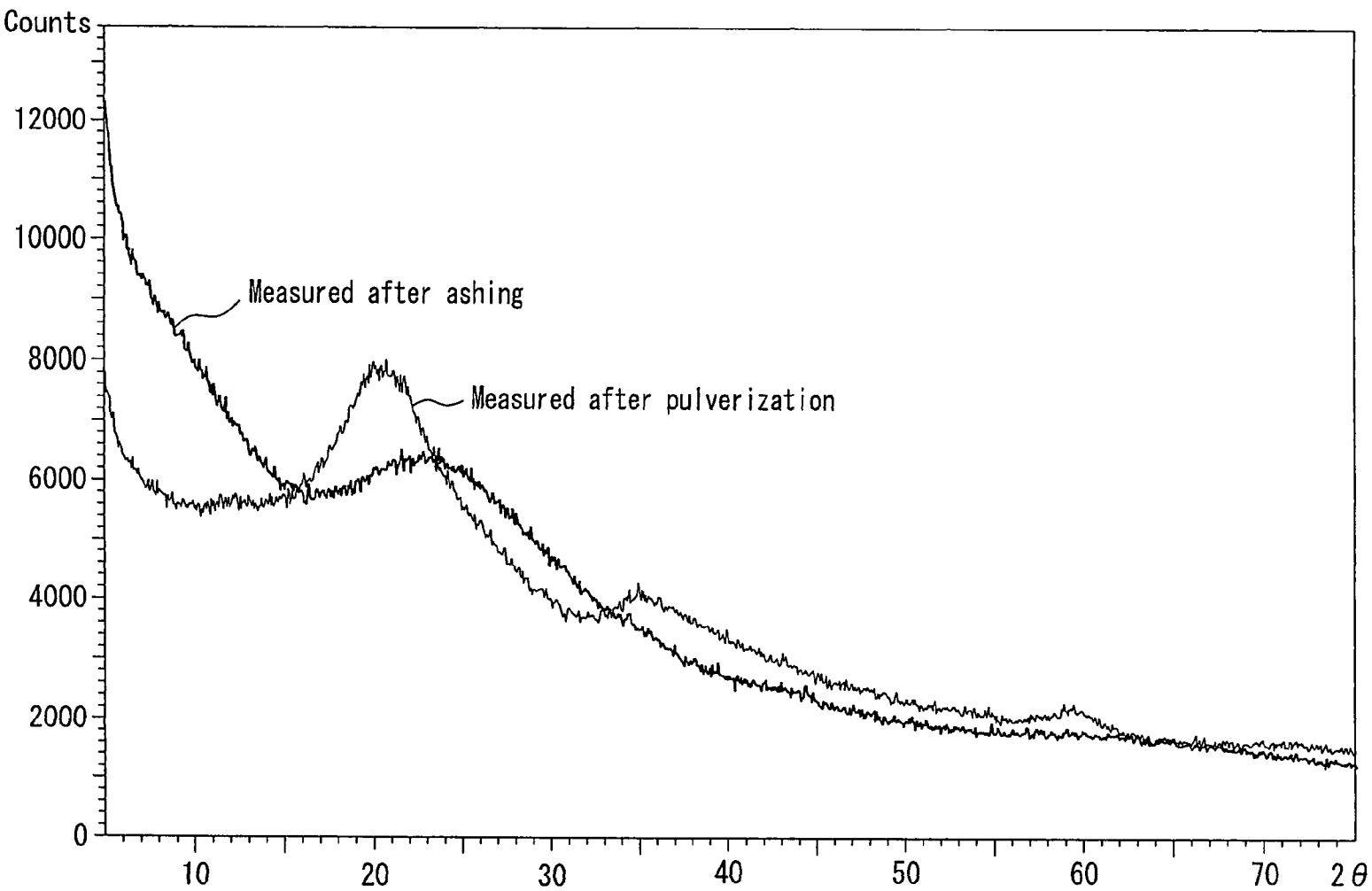
FIG. 1 is an X-ray diffraction analysis chart of rayon fibers having flameproofness in an example of the present invention.

The flameproofness in the present invention refers to the ability to prevent a material from flaming even when it catches fire. More specifically, even when in contact with a flame, an afterflame time is short and a damaged area is small. Such an ability is useful for providing a property in which, for example, even when a cigarette smoked in bed falls onto a sheet, the sheet only becomes charred and the fire does not spread.

A flameproof rayon fiber according to the present invention contains components of silicon and magnesium. The rayon fiber according to the present invention has biodegradability, and components other than a rayon component mainly form compounds containing silicon and magnesium (mainly, magnesium silicate) that have the same components as talc, which is a mineral, so that a rayon fiber with a reduced load to the environment can be achieved.

The above-noted rayon fiber is a fiber obtained by xanthating cellulose, followed by dilution and dissolution in dilute alkali so as to prepare viscose, and then coagulating and regenerating this viscose. The rayon fiber is not limited particularly by its material such as cellulose or manufacturing method.

The rayon fiber according to the present invention is obtainable by adding to a viscose solution serving as a spinning solution a silicic compound containing an alkaline metal, for example, sodium silicate ($Na_2O.nSiO_2.xH_2O$; where n is 1 to 3 and x is 10 to 20), spinning the viscose spinning solution into a spinbath containing a sulfuric acid ($H_2SO_4$), allowing the sodium silicate ($Na_2O.nSiO_2.xH_2O$) in the viscose spinning solution to react with the sulfuric acid ($H_2SO_4$) and turn into silicon dioxide ($SiO_2$; in the form of polymer), and treating the resultant fiber using a magnesium-containing solution in a scouring process or an aftertreatment process. With this treatment, silicon and magnesium react with each other to form a compound. When the above-noted rayon fiber is analyzed by an X-ray diffraction, this compound containing silicon and magnesium cannot be identified because it is amorphous. In other words, since no sharp clear peak is present but a broad peak (a halo pattern), which indicates an amorphous state, appears in the X-ray diffraction chart, the above-noted compound cannot be identified and is determined to be amorphous. Further, it is estimated that the silicic acid contained in the above-noted rayon fiber has a layered structure, and the magnesium contained therein is present in the form of magnesium hydroxide and shares part of the oxygen contained in the magnesium hydroxide with the silicic acid to form magnesium silicate ($xMgO.ySiO_2.zH_2O$; where x is 1 to 5, $y \geqq x$, and z is 1 to 3).

The above-mentioned spinbath can be a general acid spinbath, for example, a Muller bath containing $H_2SO_4$, $ZnSO_4$ and $Na_2SO_4$ in the ranges of 110 to 170 g/liter, 10 to 30 g/liter and 150 to 350 g/liter, respectively. Further, the temperature of the spinbath generally is 45° C. to 65° C. Also, the temperature of a second bath (a hot water bath) generally is 80° C. to 95° C.

The above-noted silicic compound containing an alkaline metal ranges preferably from 10% to 100% by mass and more preferably from 25% to 70% by mass on the basis of silicon dioxide ($SiO_2$) with respect to the mass of cellulose contained in the viscose solution. Since the silicic compound containing an alkaline metal in the above-described viscose spinning solution is considered to react with the sulfuric acid ($H_2SO_4$) and turn into silicon dioxide ($SiO_2$; in the form of polymer), the values are expressed on the basis of silicon dioxide ($SiO_2$). The silicon dioxide contained in the above-mentioned range makes it possible to maintain the strength and hand of the fiber, so that, when treated with the magnesium-containing solution, a rayon fiber having an excellent flame resistance can be manufactured.

Also, in the scouring process or the aftertreatment process described above, the fiber to be treated containing a silicon component that has been obtained in the spinning process is treated with the magnesium-containing solution, thereby allowing the silicon and the magnesium to react with each other, so that a compound containing silicon and magnesium is formed. The compound containing silicon and magnesium is estimated to form magnesium silicate. For example, there are a treatment of bringing the fiber to be treated into contact with the above-noted magnesium-containing solution after the hot water treatment with the sulfuric acid in the scouring process, a treatment of bringing the fiber to be treated into contact with the above-noted magnesium-containing solution instead of the sulfuric acid during the hot water treatment in the scouring process, a treatment of bringing the fiber to be treated into contact with the above-noted magnesium-containing solution after souring during the scouring process, a treatment of steeping the fiber to be treated in the above-noted magnesium-containing solution (as an aftertreatment process) after scouring and drying the fiber to be treated, or the like. At this time, the bath ratio may be selected suitably according to the magnesium-containing solution to be used, and the mass of the fiber to be treated:the mass of the magnesium-containing solution ranges from 1:20 to 1:1000, for example. Also, it is generally preferable that the bath temperature ranges from 0° C. to 100° C. and the steeping time is at least 1 minute. In the present invention, the magnesium-containing solution includes an aqueous suspension. In particular, bringing the fiber to be treated into contact with the above-noted magnesium-containing solution instead of the sulfuric acid during the hot water treatment during the scouring process is preferable because the treating time can be shortened. The reason is considered to be that, since a fiber immediately after spinning is in a swelling state, magnesium easily enters inside the fiber by bringing the fiber into contact with the magnesium-containing solution, so that the time necessary for the treatment can be shortened. In the case where the hot water treatment is carried out during the scouring process, it is preferable that the mass of the fiber to be treated:the mass of the magnesium-containing aqueous suspension ranges from 1:20 to 1:1000, the bath temperature ranges from 20° C. to 100° C. and the steeping time is 1 to 40 minutes. More preferably, the bath temperature ranges from 45° C. to 85° C. When the bath temperature is in a low temperature range, the reaction takes too long, so that it may become impossible to perform the scouring continuously. On the other hand, when the bath temperature is too high, the regeneration reaction of cellulose proceeds excessively, making it difficult for magnesium to enter inside the fiber, and such a heated alkaline solution may affect the equipment adversely.

The above-noted magnesium-containing solution is not particularly limited as long as it is a solution containing a magnesium compound that reacts with a silicon component in the fiber to be treated. However, the above-noted magnesium-containing solution preferably is an aqueous suspension of an oxide or a hydroxide of magnesium and more preferably contains an aqueous magnesium salt. The aqueous magnesium salt can be, for example, magnesium chloride, magnesium sulfate, magnesium nitrate, or the like. Also, the concentration of the magnesium oxide or magnesium hydroxide in the above-noted magnesium-containing solution ranges from 0.1% to 42% by mass and preferably from 0.1% to 10% by mass. Further, in the case where the above-noted magnesium salt is mixed, it is contained preferably in the range of 0.1% to 42% by mass and particularly preferably in the range of 0.1% to 30% by mass. In particular, it is preferable to use an aqueous suspension of the hydroxide of magnesium and magnesium sulfate. The reason is that, even if the oxide of magnesium is used, it reacts with water and turns into a hydroxide of magnesium when it is prepared as an aqueous suspension, and that, since a sulfuric acid is used in the rayon manufacturing process, a hydroxide of magnesium contained in the aqueous suspension reacts with the sulfuric acid to form magnesium sulfate. In the case of this combination, it is preferable that the concentration of the magnesium hydroxide and that of the magnesium sulfate range from 0.1% to 42% by mass and from 0.1% to 30% by mass, respectively.

The ratio of silicon to magnesium contained in the fiber ranges preferably from 1:1 to 250:1, more preferably from 1:1 to 80:1 and still more preferably from 1:1 to 60:1. The ratio of silicon to magnesium in the above-mentioned range makes it possible to manufacture a rayon fiber with still more favorable flameproofness and launderability.

The above-mentioned magnesium may be present such that at least part thereof is contained in the rayon fiber or adheres to the surface or the like of the rayon fiber. The silicon and the magnesium compound are not limited particularly by which state they are in. They may be mixed uniformly in the fiber or may be present in a compatible state or an incompatible state. The above-mentioned magnesium may be contained as a magnesium compound such as magnesium silicate, an oxide such as magnesium oxide or a magnesium salt such as magnesium hydroxide.

The ash content of the above-described flameproof rayon fiber ranges preferably from 10% to 50% by mass, more preferably from 13% to 44% by mass and particularly preferably from 23% to 41% by mass. Here, the ash content refers to an inorganic material left as a remainder after an organic material is incinerated at high temperatures. The ash content smaller than 10% by mass tends to lower the flameproofness of a flameproof rayon fiber. The ash content larger than 50% by mass tends to lower the strength of a flameproof rayon fiber or impair the hand thereof. In particular, when the ash content exceeds 40% by mass, it tends to be difficult to achieve the same hand as a conventional rayon fiber that does not use a flame retardant or the like. Then, by setting the ash content of the flameproof rayon fiber according to the present invention to the above-described range, it becomes possible to achieve a flameproof rayon fiber that has excellent flame resistance and favorable hand. Incidentally, the above-noted ash content is a value expressed by percent by mass of the mass of a component remaining after burning a flameproof rayon fiber at 850° C. with respect to an absolute dry mass of the flameproof rayon fiber. (JIS L 1015 8.20)

The launderability of the flameproof rayon fiber can be determined by laundering the fiber according to AATCC 124-1996 and measuring the ash content after laundering. The above-noted ash content after laundering preferably is at least 10% by mass. As a method for determining the launderability in a simplified manner, it also is possible to make the determination by treating the fiber under conditions of 60° C. bath temperature, 1:100 bath ratio and 120 minute steeping time in the bath containing 3% by mass of sodium carbonate, followed by sufficient water-washing and drying and then measuring the ash content similarly. The content of silicon in the flameproof rayon fiber ranges preferably from 2% to 23% by mass, further preferably from 3% to 19% by mass and particularly preferably from 5% to 18% by mass in the case of measurement by an X-ray fluorescence analysis. In the flameproof rayon fiber according to the present invention, by setting the silicon content to the above-noted range, it is possible to maintain the strength and hand of the rayon fiber.

The content of magnesium in the flameproof rayon fiber ranges preferably from 0.05% to 20% by mass, further preferably from 0.1% to 13% by mass and particularly preferably from 0.25% to 7% by mass in the case of measurement by an X-ray fluorescence analysis. In the flameproof rayon fiber according to the present invention, by setting the magnesium content to the above-noted range, it is possible to achieve a flameproof rayon fiber that has more favorable flameproofness and launderability.

The above-described flameproof rayon fiber is not particularly limited by its fineness. In general, the fineness of the rayon fiber ranges from 1 to 17 dtex and preferably from 1.7 to 10 dtex. The fineness smaller than 1 dtex tends to lower the strength of the rayon fiber, whereas the fineness exceeding 17 dtex tends to result in coarseness because of its excessively large fiber diameter. Also, the above-described flameproof rayon fiber is not particularly limited by its length, either, and can be used as a filament or a staple. The fiber length can be set freely, and the fiber with a length of 5 to 20 mm can be used as a paper screen, a wallpaper or the like and that with a length of 20 to 200 mm can be used for a non-woven fabric or a spun yarn. A filament tow can be used without cutting after the scouring.

The cross-section of the rayon fiber is not particularly limited by its shape but can be selected suitably according to the intended use. For example, a circular shape, a deformed circular shape, a hollow shape, an oblate shape, etc. can be selected.

The flameproof rayon fiber according to the present invention has useful physical properties that rayon, which is regenerated cellulose, generally has (for example, biodegradability, water absorptivity, hygroscopicity, antistatic property, thermal stability, etc.).

The rayon fiber, which is a principal component of the flameproof rayon fiber according to the present invention, has biodegradability and is decomposed within 1 to 3 months when buried in the soil, for example. Furthermore, components other than the rayon fiber mainly are compounds containing silicon and magnesium (mainly, magnesium silicate) that have the same components as talc. Some magnesium silicate having a crystal structure is classified as asbestos and shown to pose a risk to a human body. However, the components contained in the rayon fiber according to the present invention are amorphous, not classified as asbestos and do not pose any risk to a human body. Also, the drainage water during the production contains magnesium ions, which are essential elements and put less load on the environment compared with aluminum ions. Consequently, the flameproof rayon fiber according to the present invention has a high degree of safety and puts little load to the environment.

In the method for manufacturing a flameproof rayon fiber according to the present invention, a silicate compound containing an alkaline metal is added to a viscose solution. The above-noted silicate compound containing an alkaline metal can be, for example, sodium silicate, potassium silicate or the like. The process of adding the silicate compound containing an alkaline metal such as sodium silicate may be carried out by mixing an aqueous solution of the silicate compound containing an alkaline metal in a general viscose solution.

The ratio of the sodium silicate to be added ranges preferably from 10% to 100% by mass, further preferably from 15% to 80% by mass and particularly preferably from 30% to 70% by mass on the basis of $SiO_2$ with respect to cellulose in the viscose solution. By setting the amount of sodium silicate to the above-mentioned range, it is possible to adjust the amount of silicon dioxide contained in the fiber to be treated to the amount suitable for the above-described flameproof rayon fiber according to the present invention. The above-noted sodium silicate can be, for example, sodium silicate No. 3 (JIS K 1408).

The above-noted viscose solution may have a general composition. For example, it is possible to use a viscose solution containing cellulose, NaOH and $CS_2$ in the ranges of 5% to 15% by mass, 5% to 10% by mass and 1% to 5% by mass, respectively, or the like.

As described above, the flameproof rayon fiber according to the present invention is a rayon fiber that has excellent flameproofness and launderability. Also, the rayon fiber achieves favorable handling, resistance to dry-cleaning and biodegradability. The flameproof rayon fiber according to the present invention is processed into woven fabric, knit fabric, non-woven fabric, etc. and useful for the purposes such as disaster prevention items, kitchen fan filters, sheets, pillow cases, bedding mats, bedding covers, fire protection screens, interior goods (carpets, chair coverings, curtains, wall paper bases, wall materials, etc.), vehicle interior materials (mats, lining fabric, etc.), etc., for example.

The following is a more specific description of the present invention by way of examples. It should be noted that the present invention is by no means limited by the examples below.

EXAMPLE 1

(1) Manufacture of Viscose Spinning Solution

A viscose solution containing 8.5% by mass of cellulose, 5.7% by mass of sodium hydroxide and 2.6% by mass of carbon disulfide was produced. First, a mixture solution of No. 3 sodium silicate (according to JIS K 1408), sodium hydroxide and water was prepared such that cellulose accounted for 6.8% by mass and sodium hydroxide accounted for 7.5% by mass, and then added to the produced viscose solution, thus making a sodium silicate-added viscose spinning solution. The ratio of added sodium silicate was 50% by mass on the basis of $SiO_2$ with respect to the mass of cellulose.

(2) Spinning

The above-described sodium silicate-added viscose spinning solution was spun at a spinning speed of 50 m/min and at a stretch ratio of 50% by two bath stretch spinning, thus obtaining fibers having a fineness of about 3.3 dtex. The composition of a first bath (a spinbath) was such that a sulfuric acid accounted for 115 g/liter, zinc sulfate accounted for 15 g/liter and sodium sulfate accounted for 350 g/liter, and the temperature of the first bath was 50° C. The temperature of a second bath (a hot water bath) was set to 85° C., and the sodium silicate-added viscose spinning solution was extruded through a spinneret, thus producing a silicon-containing rayon filament tow (fibers to be treated).

(3) Scouring

The scouring was performed by cutting the above-described filament tow into a fiber length of 51 mm using a cutter. The scouring process included a hot water treatment, bleaching, souring and water-washing in this order. Excess liquid was removed using compression rollers, followed by drying for 7 hours in a constant-temperature dryer at 60° C. The resultant fibers to be treated had physical properties such as a fineness of 3.3 dtex, a dry strength of 1.4 cN/dtex, a wet strength of 0.8 cN/dtex, a dry elongation of 25% and a wet elongation of 20%.

(4) Aftertreatment

As a magnesium-containing solution, an aqueous suspension containing 5% by mass of magnesium chloride and 5% by mass of magnesium oxide (the bath temperature was 20° C.) was used. In this aqueous suspension, the above-described dried fibers to be treated were steeped for 2 days. At this time, the bath ratio was set such that the mass of the rayon fibers:the mass of the aqueous suspension was 1:40. Next, the fibers were water-washed and then dewatered centrifugally. Finally, the fibers were dried for 30 minutes in a constant-temperature dryer at 105° C., thereby obtaining flameproof rayon fibers b according to the present example (in the following, referred to as fibers b).

EXAMPLE 2

Except that an aqueous suspension containing 5% by mass of magnesium sulfate and 5% by mass of magnesium oxide was used as the magnesium-containing aqueous suspension in the aftertreatment, flameproof rayon fibers c according to the present example (in the following, referred to as fibers c) were manufactured similarly to Example 1.

EXAMPLE 3

Except that an aqueous suspension containing 5% by mass of magnesium sulfate and 5% by mass of magnesium hydroxide was used as the magnesium-containing aqueous suspension in the aftertreatment, flameproof rayon fibers d according to the present example (in the following, referred to as fibers d) were manufactured similarly to Example 1.

Comparative Example 1

Except that the fibers to be treated were not subjected to the aftertreatment with the magnesium-containing aqueous suspension, flameproof rayon fibers a according to the present comparative example (in the following, referred to as fibers a) were manufactured similarly to Example 1.

EXAMPLE 4

With a treatment similar to Example 1, a filament tow (fibers to be treated) was obtained. Subsequently, the scouring was performed by cutting the above-noted filament tow into a fiber length of 51 mm using a cutter. The scouring process included steeping the fibers in a suspension containing 8% by mass of magnesium hydroxide and 4% by mass of magnesium sulfate with a bath temperature of 50° C. for 1 minute as the hot water treatment, and then water-washing the fibers sufficiently. After the water-washing, oiling was carried out, followed by sufficient dewatering and drying (at 60° C. for 7 hours), thus obtaining flameproof rayon fibers f according to the present example (in the following, referred to as fibers f).

EXAMPLE 5

Except for steeping the fibers in an aqueous suspension containing 0.1% by mass of magnesium hydroxide and 1% by mass of magnesium sulfate for 10 minutes as the hot water treatment in the scouring, flameproof rayon fibers g according to the present example (in the following, referred to as fibers g) were obtained similarly to Example 4.

EXAMPLE 6

Except for steeping the fibers in an aqueous suspension containing 0.1% by mass of magnesium hydroxide for 10 minutes as the hot water treatment in the scouring, flameproof rayon fibers h according to the present example (in the following, referred to as fibers h) were obtained similarly to Example 4.

EXAMPLE 7

Except for steeping the fibers in an aqueous suspension containing 0.1% by mass of magnesium hydroxide for 7 minutes as the hot water treatment in the scouring, flameproof rayon fibers i according to the present example (in the following, referred to as fibers i) were obtained similarly to Example 4.

Comparative Example 2

Except that an aqueous suspension containing 5% by mass of calcium chloride and 5% by mass of calcium oxide was used as a calcium-containing aqueous suspension in the aftertreatment, flameproof rayon fibers e according to the present comparative example (in the following, referred to as fibers e) were obtained similarly to Example 4.

(Performance Test)

(1) Ash Content

The mass of a component remaining after burning each of the fibers a to e of mass 1 g for 2 hours in an electric oven at 850° C. was measured so as to determine their ash content. Incidentally, the ash content is a percent by mass of the mass of the residual component after burning with respect to the mass obtained by subtracting a water content from the mass of the fibers. Further, after the fibers a to d were water-washed, their ash contents were determined in a similar manner. The water-washing was carried out as follows.

[Water-washing]

The fibers a to d of mass 20 g were shaken in 500 ml of pure water (the bath temperature was 90° C.) for 18 minutes using a constant-temperature shaker (manufactured by TOKYO RIKAKIKAI CO. LTD; trade name "EYELA NTS3000"), and then rinsed out twice in hot water.

After the fibers a to e were pseudo-laundered, their ash contents were determined in a similar manner. The pseudo-laundering was carried out as follows.

[Pseudo-laundering]

The rayon fibers were steeped in a 3% by mass of sodium carbonate aqueous solution (at 60° C. for 120 minutes) such that the mass ratio of the rayon fibers to the sodium carbonate solution was 1:100, followed by sufficient rinsing with water.

The results are shown in Table 1 below.

(2) Flameproofness

The fibers a to e were spread flat into a plate shape, subjected directly to a flame of a disposable lighter (the flame length was 2.5 cm) that was located 2 cm below them, and observed. The flame was applied perpendicularly to the fiber mass. It is noted that the evaluation sample (fiber mass) was produced by opening 1 to 2 g of cut fibers into a web using a carding machine and rendering this web in the form of fiber mass. Further, the fibers a to d were water-washed as described above, subjected to a flame in a similar manner and observed, whereas the fibers a to e were pseudo-laundered as described above, subjected to a flame in a similar manner and observed.

The flameproofness was evaluated with A indicating the case in which "the fire does not spread even when the flame was applied," B indicating the case in which "although the fire does not spread even when the flame was applied, a flame is left" and C indicating the case in which "the fire spreads when the flame was applied."

These results are shown in Table 1.

TABLE 1

| | | Fiber a | Fiber b | Fiber c | Fiber d | Fiber e |
|---|---|---|---|---|---|---|
| Bath composition | | (untreated) | $MgCl_2$/MgO | $MgSo_4$/MgO | $MgSO_4$/$Mg(OH)_2$ | $CaCl_2$/CaO |
| Bath concentration (%) | | — | 5/5 | 5/5 | 5/5 | 5/5 |
| After-treatment | Ash content (%) | 30.1 | 28.4 | 28.4 | 28.1 | 27.0 |
| | Flameproofness evaluation | B | A | A | A | B |
| Water-washing | Ash content (%) | 29.6 | 28.3 | 28.1 | 27.5 | — |
| | Flameproofness evaluation | B | A | A | A | — |
| Pseudo-laundering | Ash content (%) | 2.0 | 27.6 | 27.5 | 26.8 | 4.2 |
| | Flameproofness evaluation | C | A | A | A | C |

From Table 1, it was confirmed that the fibers b to d had flameproofness and that, since the decrease in ash content of the fibers c due to the water-washing was smaller than that of the fibers a, the fibers c had launderability. Also, since the fibers b to d that were subjected to the aftertreatment using the aqueous suspension containing magnesium oxide or magnesium hydroxide and a water-soluble magnesium salt achieved a high flameproofness evaluation and had their ash content and flameproofness evaluation that hardly changed due to the water-washing, it was confirmed that they had particularly favorable flame resistance and launderability.

Further, since Table 1 indicates that the decrease in ash content of the fibers b to d due to the pseudo-laundering was smaller than that of the fibers a, the fibers b to d were confirmed to have improved alkali proofness and thus achieve launderability. Moreover, since the fibers b to d that were subjected to the aftertreatment using the aqueous suspension containing magnesium oxide or magnesium hydroxide and an aqueous magnesium salt had their ash content and flameproofness evaluation that did not change very much due to the pseudo-laundering, it was confirmed that they had particularly favorable flameproofness and launderability. Furthermore, although the similar aftertreatment was carried out using homologous calcium, such an aftertreatment using calcium did not achieve launderability.

Similarly, the fibers f to i were subjected to the pseudo-laundering, and their ash contents were measured and their flameproofnesses were evaluated before and after the pseudo-laundering. Further, after the fibers a, f to i were laundered, their ash contents were determined in a similar manner and their flameproofnesses were evaluated. The results thereof are shown in Table 2. The above-noted laundering was carried out as follows.

[Laundering]

According to the laundering test method specified in AATCC 124-1996, 300 g of cut fibers were put in a 25 cm×20 cm bag made of white cotton fabric, and laundered ten times.

TABLE 2

| | | Fiber a | Fiber f | Fiber g | Fiber h | Fiber i |
|---|---|---|---|---|---|---|
| Bath composition | | (untreated) | | $Mg(OH)_2$/$MgSO_4$ | | |
| Bath concentration (%) | | — | 8/4 | 0.1/1 | 0.1/0 | 0.1/0 |
| Hot water treating time (min) | | — | 1 | 10 | 10 | 7 |
| Scouring | Ash content (%) | 30.1 | 31.0 | 30.1 | 30.4 | 30.2 |
| | Flameproofness evaluation | B | A | A | A to B | A to B |
| Pseudo-laundering | Ash content (%) | 2.0 | 16.9 | 12.3 | 11.2 | 10.8 |
| | Flameproofness evaluation | C | A | A | B | B |
| Laundering | Ash content (%) | 3.9 | 15.4 | 14.7 | 14.0 | 13.8 |
| | Flameproofness evaluation | C | A | A | A to B | A to B |

From Table 2, it was confirmed that the fibers f to i had flameproofness and that, with a treatment with the aqueous suspension containing magnesium oxide or magnesium hydroxide and a water-soluble magnesium salt in a hot water stage during the scouring, it was possible to reduce the processing time considerably. Further, since the decrease in ash content of these fibers due to the pseudo-laundering was smaller than that of the fibers a, it was confirmed that these fibers had improved alkali proofness. Also, since the fibers f and g that were scoured using the aqueous suspension containing magnesium oxide or magnesium hydroxide and a water-soluble magnesium salt and the fibers h and i that were scoured using the aqueous suspension containing magnesium oxide or magnesium hydroxide achieved a high flameproofness evaluation and had an ash content that did not change very much due to the pseudo-laundering, it was confirmed that they had favorable flameproofness and launderability.

Furthermore, when laundered according to AATCC 124-1996, the decrease in ash content of the fibers f to i was smaller than that of the fibers a, and thus, they were confirmed to have launderability. It was confirmed that, with a treatment with the aqueous suspension containing magnesium oxide or magnesium hydroxide and a water-soluble magnesium salt in a hot water stage during the scouring, it was possible to reduce the processing time considerably. Further, since the decrease in ash content of these fibers due to the laundering was smaller than that of the fibers a, it was confirmed that these fibers had improved launderability.

Next, the fibers a, d, f to i were each processed into a water jet needling non-woven fabric having a mass per unit area of 100 g/m$^2$, and the flame retardancy evaluation (the measurement of an LOI value) was made by an oxygen index method. The results are shown in Table 3. Incidentally, the flame retardancy evaluation (the measurement of an LOI value) was carried out as follows.

[Flame Retardancy Evaluation (Measurement of LOI Value)]

According to JIS K7201, the minimum oxygen concentration when a test piece keeps burning for at least 3 minutes or when the burning length is at least 50 mm even if the burning time is shorter than 3 minutes (the LOI value) was determined. Also, the LOI value of the non-woven fabric subjected to the pseudo-laundering similarly to the above was measured in a similar manner. It is noted that, before the test, a pretreatment was carried out in a constant-temperature atmosphere at 50° C. for 24 hours.

TABLE 3

| | | Fiber a | Fiber d | Fiber f | Fiber g | Fiber h | Fiber i |
|---|---|---|---|---|---|---|---|
| Bath composition | | (untreated) | | $Mg(OH)_2/MgSO_4$ | | | |
| Bath concentration (%) | | — | 5/5 | 8/4 | 0.1/1 | 0.1/0 | 0.1/0 |
| Treating time | | — | 2 days | 1 min. | 10 min. | 10 min. | 7 min. |
| LOI value | Before pseudo-laundering | 18.0 | 27.4 | 25.5 | 23.8 | 23.8 | 23.8 |
| | After pseudo-laundering | 18.0 | 27.4 | 23.4 | 22.1 | 21.7 | 21.7 |

(3) Component Analysis

In order to analyze the component of the fibers c, X-ray diffraction analysis and X-ray fluorescence analysis were carried out. Also, the fibers f to i were subjected to the X-ray fluorescence analysis.

(3-1) X-ray Diffraction Analysis

The X-ray diffraction analysis was performed using a fully-automatic multipurpose X-ray diffractometer "PW3050," manufactured by Philips Japan, Ltd. The outline of this measurement device and the measurement condition are as follows.

(i) Outline of the Measurement Device

Driving system: stationary specimen vertical goniometer

X-ray tube: 2.2 kw, Cu target

Detector: proportional counter (ii) Measurement Condition

Optical system: focusing optical system (Normal θ/2θ)

Monochromator: curved graphite monochromator was used.

Tube voltage—tube current: 40 kw—45 mA

Two kinds of samples that were prepared respectively by pulverizing the fibers c and ashing the fibers c were measured. The samples were spread so as not to be thick such that a 10 mm×10 mm surface was irradiated, and measured.

FIG. 1 shows a diffraction analysis chart.

(3-2) X-Ray Fluorescence Analysis

The X-ray fluorescence analysis was performed using an X-ray fluorescence spectrometer "LAB CENTER XRF-1700," manufactured by Shimadzu Corporation, by a theoretical calculation by an FP method. The outline of this measurement device and the measurement condition are as follows.

(i) Outline of the Measurement Device

Range of elements to be measured: $_4$Be—$_{92}$U

X-ray tube: 4 kw thin window, Rh target

Spectral element: LiF, PET, Ge, TAP, SX

Primary X-ray filter: four-kind automatic exchange (Al, Ti, Ni, Zr)

Field stop: five-kind automatic exchange (diameters of 1, 3, 10, 20, 30 mmϕ)

Detector: scintillation counter (heavy element), proportional counter (light element)

(ii) Measurement Condition

Tube voltage—tube current: 40 kw—95 mA

Cut fibers of the fibers c served as a sample and were measured. The measurement was made such that the irradiation surface was adjusted to be 10 mm in diameter and several millimeters in thickness and irradiated with light reaching from above and passing therethrough.

In the resultant X-ray diffraction analysis chart shown in FIG. 1, neither of the analysis charts after ashing and pulverization showed a sharp clear peak. Compounds containing silicon and magnesium components show a clear peak near a diffraction angle 2θ of 22°. The peak measured after ashing was present near a diffraction angle 2θ of 21° to 23° but was a broad peak (a halo pattern), which indicated amorphism. Also, the peak measured after pulverization was present near a diffraction angle 2θ of 20°, which is considered to be a peak of cellulose. Accordingly, it was not possible to identify the compound for the above-described reason, and an inorganic component contained in the fibers c was found to be amorphous. Further, the fibers f to i were subjected to the X-ray diffraction analysis and found to be amorphous, similarly to the above result. Table 4 shows the results of the X-ray fluorescence analysis of the fibers c, f to i and general rayon fibers, and Table 5 shows the components of the fibers c, f to i estimated from the results of the X-ray fluorescence analysis and their contents. Also, Table 5 shows the ash contents of the fibers c, f to i. Incidentally, the general rayon fibers refer to rayon fibers that are manufactured by a general manufacturing method in which sodium silicate is not added to viscose and the aftertreatment using the magnesium-containing solution is not performed.

TABLE 4

| | Element content (%) | | | | | |
|---|---|---|---|---|---|---|
| | O | C | Si | Mg | S | Other elements |
| Rayon fiber (theoretical value) | 57 | 43 | 0 | 0 | 0 | 0 |
| Fiber c | 54 | 32 | 9 | 4.7 | 0.01 | 0.29 |
| Fiber f | 54 | 31 | 12.5 | 2.0 | 0.05 | 0.45 |
| Fiber g | 55 | 31 | 13.4 | 0.3 | 0.05 | 0.25 |
| Fiber h | 55 | 31 | 13.6 | 0.1 | 0.06 | 0.24 |
| Fiber i | 55 | 31 | 13.6 | 0.06 | 0.07 | 0.27 |

TABLE 5

| | Estimated content value (% by mass) | | | |
|---|---|---|---|---|
| | $SiO_2$ | MgO | Other inorganic substance | Ash content |
| Fiber c | 19.25 | 7.79 | 1.36 | 28.4 |
| Fiber f | 26.74 | 3.32 | 0.94 | 31.0 |
| Fiber g | 28.66 | 0.50 | 0.94 | 30.1 |
| Fiber h | 29.09 | 0.17 | 1.14 | 30.4 |
| Fiber i | 29.09 | 0.10 | 1.01 | 30.2 |

From Tables 4 and 5, the fibers c, f to i are considered to contain components of silicon and magnesium and form magnesium silicate. Moreover, because of a slight sulfur content, it can be estimated that the magnesium compound mostly contains oxides and hardly contains sulfated compounds. Further, from these results, the fibers b and d also are assumed to form magnesium silicate similarly to the fibers c, f to i.

From the results above, it was found that a longer treating time with the magnesium-containing solution increased the magnesium content in the fibers, leading to an improved flameproof performance. Moreover, it was found that, with an increase in the concentrations of magnesium hydroxide and magnesium sulfate in the aqueous suspension, the magnesium content in the fibers rose, leading to an improved flameproof performance.

Also, the hot water treatment during the scouring process was replaced by the treatment with the solution containing magnesium oxide or magnesium hydroxide, thereby making it possible to shorten the treating time considerably. The reason is considered to be that, since the fibers immediately after spinning are in a swelling state, magnesium enters inside the fibers easily. Accordingly, the time necessary for the treatment can be shortened when the treatment with the aqueous suspension of magnesium hydroxide and magnesium sulfate is carried out in the scouring. Once the fibers are dried, they do not swell as much as they do immediately after spinning, making it more difficult for magnesium to enter inside the fibers, so that about two days were necessary for the aftertreatment. Furthermore, it was found that the processing time was adjustable by changing the concentrations of magnesium hydroxide and magnesium sulfate contained in the aqueous suspension. In the case where magnesium sulfate was not used in the treatment bath, the content of magnesium in the fibers tended to be low. Since a sulfuric acid is contained in cut chips before the scouring, the magnesium hydroxide and the sulfuric acid react with each other in the scouring hot water so as to form magnesium sulfate. Because only a slight amount of this magnesium sulfate is formed, the content of magnesium in the fibers is considered to have decreased.

INDUSTRIAL APPLICABILITY

As described above, the present invention can provide a flameproof rayon fiber that achieves excellent flame retardance and has launderability and resistance to dry-cleaning, and a method for manufacturing the same. Also, the rayon fiber, which is a principal component of the present invention, has biodegradability, while other components mainly are compounds containing silicon and magnesium (mainly, magnesium silicate) that have the same components as talc, which is a mineral, so that a flameproof rayon fiber with a reduced load to the environment can be provided. In particular, the flameproof rayon fiber according to the present invention can be used as a material replacing glass fibers, asbestos, aramid fibers, etc., which have been used conventionally in flameproof products. The flameproof rayon fiber according to the present invention is processed into woven fabric, knit fabric, non-woven fabric, etc. and useful for the purposes such as disaster prevention items, kitchen fan filters, sheets, pillow cases, bedding mats, bedding covers, fire protection screens, interior goods (carpets, chair coverings, curtains, wall paper bases, wall materials, etc.), vehicle interior materials (mats, lining fabric, etc.), etc., for example.

The invention claimed is:

1. A flameproof rayon fiber, comprising:

a rayon fiber, and an amorphous compound comprising silicon and magnesium within the rayon fiber, wherein the rayon fiber has an ash content ranging from 10% to 50% by mass, and when subjected to an X-ray fluorescence analysis, the rayon fiber has a silicon content ranging from 2% to 23% by mass and a magnesium content ranging from 0.05% to 20% by mass, and the fiber is flameproof.

2. The flameproof rayon fiber according to claim 1, wherein a content ratio of the silicon to the magnesium (silicon magnesium) within the rayon fiber ranges from 1:1 to 250:1.

3. The flameproof rayon fiber according to claim 1, wherein the compound comprising silicon and magnesium within the rayon fiber is substantially in a form of magnesium silicate.

* * * * *